United States Patent [19]

Ghigliotti et al.

[11] Patent Number: 4,486,068

[45] Date of Patent: Dec. 4, 1984

[54] PIN MEMBER FOR AN ELECTRICAL CONNECTOR AND A METHOD FOR MAKING SAME

[75] Inventors: Giovanni Ghigliotti, Genova-Pegli; Attilio Lancella, Genova-Sestri, both of Italy

[73] Assignee: Connei S.p.A., Italy

[21] Appl. No.: 435,986

[22] Filed: Oct. 22, 1982

[30] Foreign Application Priority Data

Oct. 28, 1981 [IT] Italy ..... 12660 A/81

[51] Int. Cl.[3] ..... H01R 13/06

[52] U.S. Cl. ..... 339/252 P

[58] Field of Search ..... 339/252 R, 252 P, 255 RT, 339/256 R, 256 RT

[56] References Cited

U.S. PATENT DOCUMENTS 1,833,145 11/1931 Wilhelm ..... 339/256 R
3,286,671 11/1966 Fuller ..... 339/252 P

FOREIGN PATENT DOCUMENTS 441148 5/1941 Belgium .
61587 10/1982 European Pat. Off. ..... 339/256 R
138993 3/1930 Switzerland .
2065993 7/1981 United Kingdom ..... 339/256 R

*Primary Examiner*—Joseph H. McGlynn
*Attorney, Agent, or Firm*—Lowe, King, Price & Becker

[57] ABSTRACT

A pin member (1) for electrical connectors of the pin and socket type comprises a cylindrical hollow metal body provided with through slots (4) in the cylindrical surface thereof. The slots are inclined with respect to the longitudinal axis of the body. The body is permanently deformed by twisting it a predetermined amount in a direction opposite to the inclination of the slots (4), causing an outward expansion or bulging of strips defined (8) between adjacent slots to increase the outer diameter of the hollow cylindrical body at intermediate portions of the slots.

11 Claims, 8 Drawing Figures

PIN MEMBER FOR AN ELECTRICAL CONNECTOR AND A METHOD FOR MAKING SAME

SUMMARY OF THE INVENTION

The present invention relates to a pin member for electrical connectors of the pin and socket type, and a method for making same.

The pin member of the invention is obtained by permanent deformation, in accordance with a pre-established angle of rotation, of a cylindrical sleeve provided with through slots arranged on its cylindrical surface and inclined with respect to the longitudinal axis of the sleeve. Twisting occurs in a direction opposite the inclination of the slots, causing outward bulging of the strips defined by each pair of slots so that the outer diameter of the sleeve progressively increases at an intermediate portion thereof along the strips, establishing an elastic element of the pin member.

This pin member is particularly suitable for insertion (connection) into a cylinderical socket but can also be inserted into other sockets, e.g., polygonal sockets.

The advantages of the pin member according to the invention, with particular reference to the insertion thereof into a cylindrical socket, can be summarized as follows:

(a) an extended contact surface of the elastic element of the pin member with the inside surface of the socket, so as to obtain an optimum contact area;

(b) a reduced and progressive resistance of the elastic element, achieving an extremely smooth connection and disconnection;

(c) an operating range of the elastic element well within the elasticity range limits of the material, so as to achieve a high mechanical reliability even after several connection and disconnection operations.

BRIEF DESCRIPTION OF THE DRAWINGS

The above and other characteristics features of the pin member according to the invention and the method for making same, as well as the advantages resulting therefrom, will be more apparent from the following description, made as a non-limiting example, of a preferred embodiment thereof, with reference to the Figures of the accompanying drawings, in which.

DESCRIPTION OF THE PREFERRED EMBODIMENT

Figure 1:
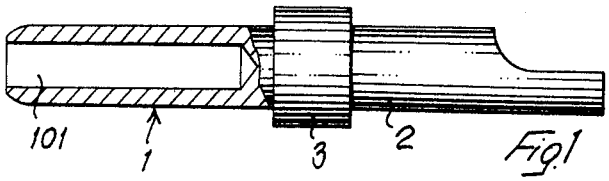
FIG. 1 is a side elevation and partly sectional view of the cylindrical sleeve from which the pin member is obtained.

Referring to FIG. 1, shows a pin member 1 adapted to be the male element of an electrical connector is formed from a solid bar machined to have a bore 101 formed within a cylindrical sleeve closed at one end or base. The male or pin member 1 has a hollow appendix 2 which is also obtained by suitable machining of the extension of the closed end portion of the cylindrical sleeve The hollow appendix 2 is adapted for connection (in a known manner) with the terminal of an electrical cable (not shown). Obviously, the shape and size of appendix 2 can be modified in any known manner easily conceivable by a person skilled in the art, depending upon the required type of connection. The pin member 1 is made of any suitable conductive metal, such as a brass alloy normally used in electrical components.

At the closed or rear (with respect to the direction of insertion of the pin into the socket) end of the pin member, an annular projection 3 is formed by machining and serves mainly as an abutment member to limit the extent of insertion of the pin 1 into the socket upon connection thereof. The open or front end of the pin member 1 is formed with a suitably rounded or bevelled edge to facilitate insertion of the pin into the socket.

A plurality of angularly equispaced slots 4 are arranged on the entire cylindrical circumference of pin 1. Slots 4 are preferably machined with a double-angle milling cutter 5, preferably of the equal-angle type (see FIG. 2). The angle between the two cutting edges is between 30° and 70° and preferably about 60°. Obviously, double unequal-angle cutters may also be used.

Figure 2:
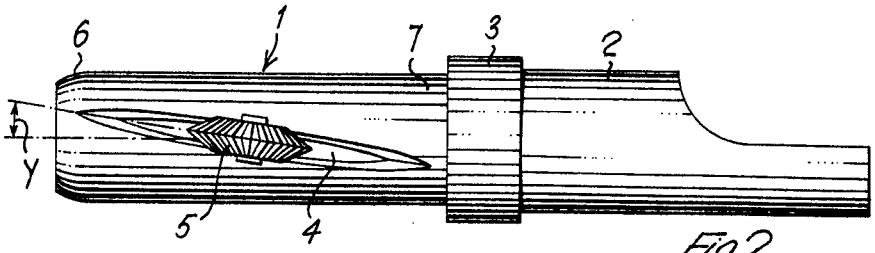
FIG. 2 is a side view of the cylindrical sleeve during mill-cutting of a slot.

As shown in FIG. 2, the plane of rotation of cutter 5 is perpendicular to a plane tangent to the outer cylindrical surface of sleeve 1 at the centre of slot 4, and also forms a predetermined angle Y with the plane containing the longitudinal axis of the sleeve 1 and the generatrix of the outer cylindrical surface lying in the plane tangent to the outer cylindrical surface. Angle Y, the angle of inclination of the milling cutter, is between 5° and 20° and preferably between 8° and 10°.

Figure 3:
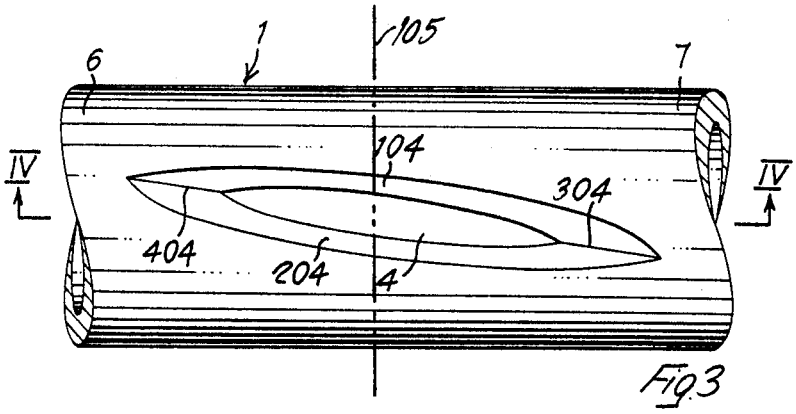
FIG. 3 is an enlarged detailed view of the shape of the slot.
Figure 4:
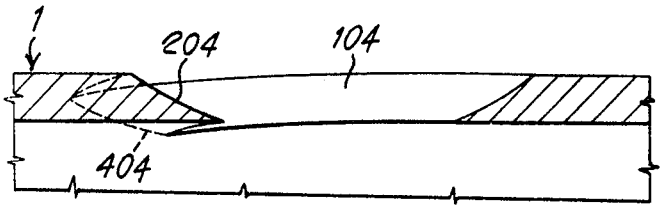
FIG. 4 is a sectional view taken along the line IV—IV of FIG. 3.

Each slot 4 is cut with the milling cutter so that the slot terminates a certain distance from the ends of the cylindrical sleeve, establishing two end ring portions 6 and 7. So that the two side surfaces of each slot 4 do not have (particularly at the intermediate zone) surfaces parallel to each other, the cutting depth of cutter 5 is less than the radial height of the cutting edges of the cutter. On the cylindrical sleeve, slots 4 thus have a geometrical profile as shown in FIGS. 3 and 4. This geometrical profile is defined by two flanges or inclined sides 104 and 204 diverging outwards and which meet each other at the ends of the slot to form edges 304 and 404 each having a curvilinear surface. The vertices of edges 304, 404 located on the inner cylindrical surface of the sleeve are closer to each other then the vertices located on the outer cylindrical sleeve surface.

If sleeve 1 has a constant sectional area, sides 104, 204 of each slot 4 present surfaces of equal area that are symmetrically arranged with respect to an axis passing through the center of the slots and perpendicular to the longitudinal axis of the sleeve. With respect to this axis edges 304, 404 will alternately separate sides 104, 204 into larger and smaller areas to different-strength form strips between adjacent slots having different strength sections at either side of edges 304 and 404, enabling the whole structure to better resist stress which will originate upon twisting of the sleeve, as described below.

Figure 5:
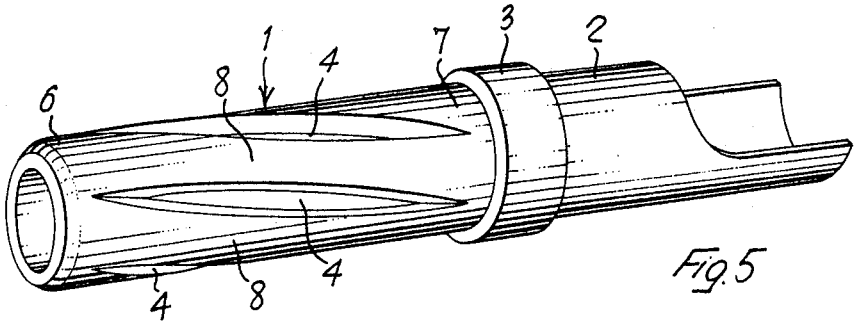
FIG. 5 is a perspective view of a pin member provided with slots prior to twisting.

FIG. 5 shows a sleeve-pin 1 provided with plural slots 4 obtained as described above. Adjacent slots 4 define therebetween a strip 8 which is inclined, with respect to the longitudinal axis of the sleeve, at angle Y.

Figure 6:
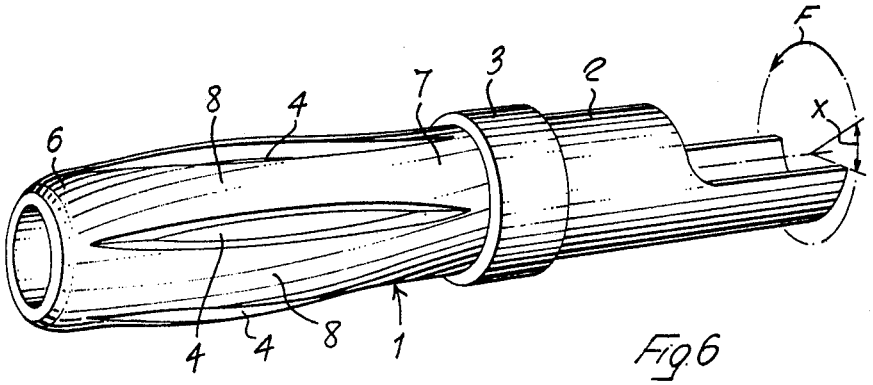
FIG. 6 is a view similar to FIG. 5, after twisting.

As shown in FIG. 6, the aforesaid sleeve is twisted via relative rotation (arrow F) through a predetermined angle X, in the direction opposite the inclination of the slots. The torque applied on the sleeve axis causes permanent deformation of the sleeve between the end rings so that strips 8 tend to bulge (expand) outwards. Bulging of the individual strips forms a region of progressively-increasing outer diameter at the intermediate portion of the sleeve, between end rings 6 and 7. The peculiar shape of slots 4, as described above, contributes in establishing appropriate deformation of the slots.

Figure 7:
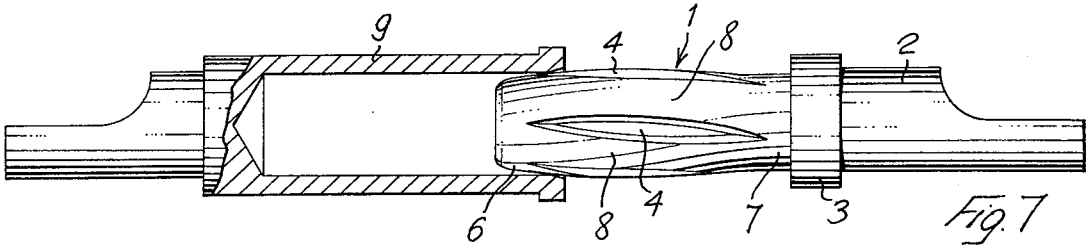
FIG. 7 is a side view of the pin member according to the invention, during insertion into a cylindrical socket shown with parts in section.

Pin 1 can now be elastically inserted into a female socket 9 (FIG. 7) having a bore of generally circular cross-section. The cross-sectional minimum bore diameter is is ideally equal to the outer diameter of sleeve 1 at rings 6 and 7, while the maximum diameter is ideally equal to twice the radius of maximum (lbulge) of the sleeve due to twisting. The arrangement of the outer surfaces of strips 8 ensures, upon insertion of the pin into the socket, a very large bearing or contact surface between the two members (i.e., pin and socket) for good electrical conduction.

Insertion of pin 1 into socket 9 causes the strips 8 to elastically deform at their contact regions, with the socket. Moreover, insertion of pin 1 into socket 9 causes a slight elastic deformation of the pin in a direction opposite the twist direction previously applied to obtain permanent deformation of the pin, i.e. a slight relative rotary movement occurs between end rings 6 and 7 in a direction opposite the twisting direction according to FIG. 6. This elastic deformation in the opposite direction ensures smoother insertion of the pin and, therefore, reduced wear between the pin and socket of the connector.

Figure 8:
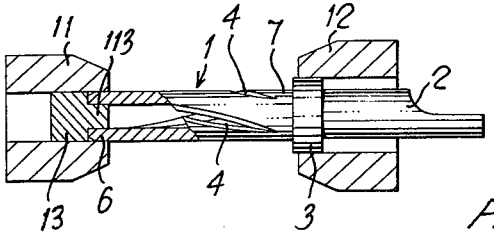
FIG. 8 diagrammatically shows a device for twisting the pin member.

With reference to FIG. 8, a device for twisting pin 1 is diagrammatically shown. This device comprises two chucks 11 and 12 arranged opposite each other and capable of effecting relative axial rotation by gripping ends of pin 1 at ring portion 6 and annular projection 3, respectively. At free end 6 of the sleeve there is arranged a support or contrast mandrel 13 provided with a projection 113 interfitting with the inlet opening of the ring portion to prevent squeezing or crushing thereof.

A typical method of making a socket member for an electrical connector of the type specified above comprises the following operational steps:

(1) Lathe machining of the sleeve starting with a solid bar stock, with terminal portions of different types depending upon actual requirements (i.e., connection with printed circuits, connection with electric cables, etc.).

(2) Axial boring of the sleeve to obtain bore 101.

(3) Cutting of slots 4 by means of a double equal-angle cutter of suitable shape.

(4) Finishing of the outer surface of the sleeve.

(5) Twisting of the sleeve through a predetermined angle X (FIG. 6).

(6) If desired or required, plating of the finished piece. In this connection, it must be noted that the presence of the slots 4 permits better penetration of a liquid used for the electro-chemical treatment of the interior of the sleeve, thus ensuring an improved uniformity of the protective layer on the whole surface of the sleeve.

The pin member can also be obtained starting from blanks which are cut from metal sheets, and in this case the above-mentioned steps (1) and (2) will be substituted by the following:

(1A) Punching of the blank from a metal sheet and subsequent shaping (by rolling) to obtain the sleeve with the inner bore, suitable means and/or operations (welding, etc.) being obviously provided to avoid the radial opening of the thus-obtained sleeve.

The sleeve can also be obtained starting from a continuous pipe, which is then cut to the desired lengths.

If the pin member is made starting from a solid rod, the cutting of the slots by means of a milling cutter can be effected prior to the axial boring of the piece.

It is to be noted, moreover, that regardless of the plating mentioned above at (6), the pin member can be subjected, before or after the steps described above, to any thermal, chemical or mechanical treatment which is deemed necessary or useful in consideration of the material (metal or alloy) being used.

It is apparent from the above that the pin member made according to the invention has, among others, the following advantages:

Extreme simplicity of construction, as regards both the object and procedure of making it;

Possibility of employing different conductive materials, while maintaining excellent features of mechanical and electrical functionality.

These advantages are actually guaranteed in consideration of the fact that, in order to obtain the required characteristic features, the following parameters can be taken in consideration (separately or jointly):

(a) number of strips 8 obtained in the pin member, and corresponding number of slots 4;

(b) shape of the slots 4;

(c) inclination angle Y of the slots 4 with respect to the axis of the pin member;

(d) twisting angle adopted for the permanent deformation of the sleeve;

(e) thickness of the strips 8;

(f) length of the strips 8 with respect to the length of the pin member;

(g) material (metal or alloy) of which the pin member is made, and thermal, chemical or mechanical treatments before and/or after the individual operational steps.

The slots 4 can either have an angularly equi-spaced positioning, or a different angular positioning, and/or be grouped in groups of at least two slots.

Therefore, it is to be understood that the invention is not limited to the embodiments described above and shown merely by way of example in the accompanying drawings, and that many changes and modifications can be made thereto without departing from the basic principle of the invention as described above and as claimed hereinafter.

We claim:

1. A pin member for pin-and-socket electrical connectors, comprising a hollow cylindrical body of electrically conductive material provided with through slots arranged on a cylindrical surface thereof, said slots respectively having a longitudinal axis inclined with respect to the longitudinal axis of said cylindrical body, each slot longitudinal axis lying in a plane, wherein said body is twisted and permanently deformed, so that strip portions of the body established between adjacent slots bulge outward from the cylindrical surface of the hollow cylindrical body to progressively increase the outer diameter of said hollow cylindrical body proximate the bulging strip portions.

2. A pin member according to claim 1, wherein said slots are arranged such that, prior to twisting deformation of the body, each slot is inclined with respect to the longitudinal axis of the hollow cylindrical body at an angle between 5° and 20°.

3. A pin member according to claim 1, wherein each slot has a configuration such that prior to twisting deformation of the body, each slot has a transverse profile with sides diverging outwards, said sides meeting each other at opposite ends of the slot to form two curvilinear edges respectively at said opposite ends so that vertices of said edges located on the inner surface of the pin member are nearer to each other than the vertices of the edges located on the outer surface which are further from each other.

4. A pin member according to claim 3, wherein the sides of each slot are inclined symmetrically with respect to a longitudinal median plane of the slot.

5. A pin member according to claim 3, wherein the sides of each slot are inclined asymmetrically with respect to a longitudinal median plane of the slot.

6. A method of manufacturing a pin member for pin and socket electrical connectors, comprising the steps of:

(a) forming a cylindrical sleeve of electrically conductive material;

(b) cutting a series of non-helical through slots in the cylindrical surface of the sleeve by means of a double-angle milling cutter;

(c) finishing the outer surface of the sleeve; and (d) twisting the sleeve through a predetermined twist angle in a direction opposite the inclination of the slots so that strip portions of the sleeve formed between adjacent slots bulge outward.

7. A method according to claim 6, wherein the cylindrical sleeve is formed by lathe machining and boring of a solid metal bar.

8. A method according to claim 6, wherein the cylindrical sleeve is formed by punching a blank from a suitable metal sheet and subsequent shaping thereof.

9. A method according to claim 6, wherein the cylindrical sleeve is formed by cutting a continuous metal pipe into desired lengths.

10. A method according to claim 6, wherein each slot is cut by double equal-angle cutters.

11. A method according to claim 6, wherein each slot is cut by double unequal-angle cutters.

* * * * *